US005385208A

United States Patent [19]

Baker et al.

[11] Patent Number: 5,385,208

[45] Date of Patent: Jan. 31, 1995

[54] AIRBORNE FIRE SUPPRESSANT FOAM DELIVERY APPARATUS

[76] Inventors: R. Arnold Baker, Rte. 1, Box 408, Manson, Wash. 98831; John L. Baker, 461 S. Miller, Wenatchee, Wash. 98801

[21] Appl. No.: 47,105

[22] Filed: Apr. 13, 1993

[51] Int. Cl.[6] ..... A62C 31/00

[52] U.S. Cl. ..... 169/46; 169/9; 169/53

[58] Field of Search ..... 169/9, 10, 14, 15, 43, 169/46, 53; 239/171; 244/136

[56] References Cited

U.S. PATENT DOCUMENTS

| | | | |
|---|---|---|---|
| 2,385,449 | 9/1945 | Koehler | 169/85 X |
| 2,492,037 | 12/1949 | Freeman et al. | 169/15 X |
| 2,829,874 | 4/1958 | Freeman | 169/15 X |
| 3,342,271 | 9/1967 | Anthony, Jr. | 169/9 X |
| 3,442,334 | 5/1969 | Gousetis | 169/53 |
| 3,580,339 | 5/1971 | Nance | 169/45 |
| 3,897,829 | 8/1975 | Eason | 169/53 |
| 3,965,988 | 6/1976 | Wesson et al. | 169/9 |
| 3,977,474 | 8/1976 | Boegli | 169/9 |
| 4,064,944 | 12/1977 | McClure et al. | 169/9 X |
| 4,729,434 | 3/1988 | Rohrbach | 169/9 X |
| 4,979,571 | 12/1990 | MacDonald | 169/44 |

FOREIGN PATENT DOCUMENTS

| | | | |
|---|---|---|---|
| 1574227 | 6/1990 | U.S.S.R. | 169/9 |

OTHER PUBLICATIONS

Vandersall, H. L., "The Use of Foam in Wildland Fire Fighting: Some of the What, etc.", Apr. 4, 1990.

"Foam: Making Water a Better Firefighter", PHOS--CHEK Monsanto Product Brochure, Pub. No. 9164.

*Primary Examiner*—David M. Mitchell
*Assistant Examiner*—Andrew C. Pike
*Attorney, Agent, or Firm*—Wells, St. John, Roberts, Gregory & Matkin

[57] ABSTRACT

An airborne foam delivery apparatus is adapted to be carried as a slung bucket beneath a helicopter to deliver a high volume of fire suppressant foam for wildland firefighting. The delivery apparatus comprises a liquid tank for holding a foamable liquid. A support frame extends downward from the liquid tank to support the liquid tank above the ground during ground operations. Three nozzles are directed generally downwardly from beneath the liquid tank within a protective apron. A liquid valve is positioned between the liquid tank and the each nozzle. Each liquid valve is remotely operable to allow passage of the foamable liquid through the corresponding nozzle. A pressure regulator is connected to receive compressed air from gas containers mounted within the liquid tank, and to controllably discharge the compressed air into the liquid tank to maintain a positive regulated pressure within the liquid tank. The positive pressure expels the foamable liquid through tile nozzles when tile liquid valves are operated. An aerating screen is positioned beneath each nozzle to aerate and foam the foamable liquid as it emerges from the nozzle.

28 Claims, 4 Drawing Sheets

AIRBORNE FIRE SUPPRESSANT FOAM DELIVERY APPARATUS

TECHNICAL FIELD

This invention relates to an airborne foam delivery apparatus for applying fire suppressant foam to wildland fires.

BACKGROUND OF THE INVENTION

Wildland fires are a threat in many areas of the world. Effectively controlling and containing these fires is essential to the preservation of national parks, forests, and private property. Significant efforts are therefore directed to developing and improving wildland firefighting techniques.

Wildlands are characterized by difficult and often inaccessible terrain. Fighting fires in such rugged terrain is difficult. In many situations, the only realistic access to burning areas is by air. Therefore, wildland firefighting efforts quite often include the application of water from fixed wing airplanes and helicopters. Water, as it is converted into steam, has tremendous capacity to absorb and carry away heat. It has the further advantage of being environmentally safe. In addition, adequate and convenient reservoirs of water can often be found near burning fires. Helicopters equipped with "slung buckets" can quickly load from such reservoirs without landing. The close proximity of a reservoir also minimizes round trip flying time.

Despite the advantages of water in fighting wildland fires, water alone can be inefficient-especially when applied from the air. Much of the water evaporates before reaching the ground. Water which does reach the ground beads up and rolls off fuels before absorbing its full heat capacity. It has been estimated that water is only 5% to 10% efficient.

Many fire retarding or suppressing chemicals are available which are more efficient than water. However, they are often difficult to use against wildland fires. One problem with such chemicals is that they are environmentally toxic. They are also difficult to transport to remote locations in large quantities. In many cases, fire retardant chemicals require specialized and bulky application equipment. Both the chemicals and the application equipment are expensive.

Foam is one type of fire suppressant which is particularly efficient in terms of both effectiveness and cost. Foam fire suppressant can be created by different methods. However, most methods start with adding a foam concentrate to water in concentrations ranging from 0.1% to 1.0%. PHOS-CHEK TM fire suppressant foam concentrate is one popular foam concentrate, available from Monsanto Chemical Company of St. Louis, Mo. One reason for its popularity in fighting wildland fires is its relative biodegradability and its approval by necessary government agencies.

Foam varies from being wet and runny to being as stiff as lather. The stiffness depends on bubble size and expansion ratio. Expansion ratio is the increase in volume as the water becomes foam. Applying foamable liquid under pressure through a standard nozzle results in a relatively low expansion ratio, and a somewhat runny foam. Special air-aspirated nozzles can result in much higher expansion ratios, producing much drier foam.

Foam fire suppressant can be applied from standard fire engines and other vehicles. Foam suppresses fires by surrounding fuel with a thick layer of water, which does not bead up and roll off. This allows the water to absorb its full capacity of heat, and also allows more water to be absorbed into the fuel. Furthermore, a foam blanket creates a vapor barrier between fuel and oncoming fire. It reflects oncoming radiant heat, insulates fuel, continuously releases water from the foam's bubble structure, and helps smother the fuel. A further advantage is that firefighters can easily see where foam has been applied.

Until recently, experts were skeptical of the utility of applying foam to wildland fires from the air. However, this skepticism has now been overcome, and foam concentrate is sometimes added to water applied from aircraft. However, because of the large volume of water which must be quickly dumped to effectively fight wildland fires, applying the water under pressure through nozzles has been impractical. Rather, the water is dumped from conventional slung buckets or fixed tanks. Foam is generated by air turbulence produced by free fall of the water.

The foam created in this manner is relatively runny, having a low expansion ratio. However, the surfactant qualities of the foam concentrate, even without thick foam, are enough of an advantage over water alone to justify the addition of foam concentrate. Nevertheless. it would be desirable to provide thicker foam from airborne applicators.

The most significant obstacle to creating high foam expansion ratios from airborne applicators is the extremely high volume of water which must be applied, at a very high flow rate. The need for a high flow rate is brought about by the speed of the aircraft. In a fixed wing airplane, minimum ground speeds are determined by the very nature of the aircraft. When a helicopter is used to apply water, downdraft or "rotor wash" from the helicopter rotors mandates minimum ground speeds. Helicopter rotor wash is a serious problem for helicopters in wildland fire fighting. It can quickly defeat the effects of applied fire suppressants. The ground turbulence from rotor wash causes the fire to expand, and can endanger nearby fire crews. To minimize rotor wash problems, water applicators are usually suspended a considerable length beneath the helicopter, such as by a distance of fifty feet or more. In addition, minimum ground speeds are maintained to reduce the rotor wash impact on any particular ground area.

The minimum ground speeds required of aircraft when fighting wildland fires mandates a very high application rate of fire suppressant. The flow from a standard firehose nozzle is simply not adequate. However, equipment to produce adequately high application rates of high-expansion foam has not been available for airborne operation. Accordingly, most firefighting efforts continue to rely on standard slung buckets, which depend on gravity to quickly jettison their entire water loads. Foam concentrate is added to the water to act as a surfactant and to provide a minimal amount of foaming through turbulence with the air.

Airborne firefighting effectiveness could be significantly improved if it were possible to apply high-expansion foam from aircraft at application rates approaching those achieved with standard slung buckets. To this date, however, there exists no practical high-expansion foam applicator which will achieve these rates. The invention described below fills the need for such an airborne foam applicator.

BRIEF DESCRIPTION OF THE DRAWINGS

A preferred embodiment of the invention is described below with reference to the accompanying drawings.

DETAILED DESCRIPTION OF THE PREFERRED EMBODIMENT

Figure 1:
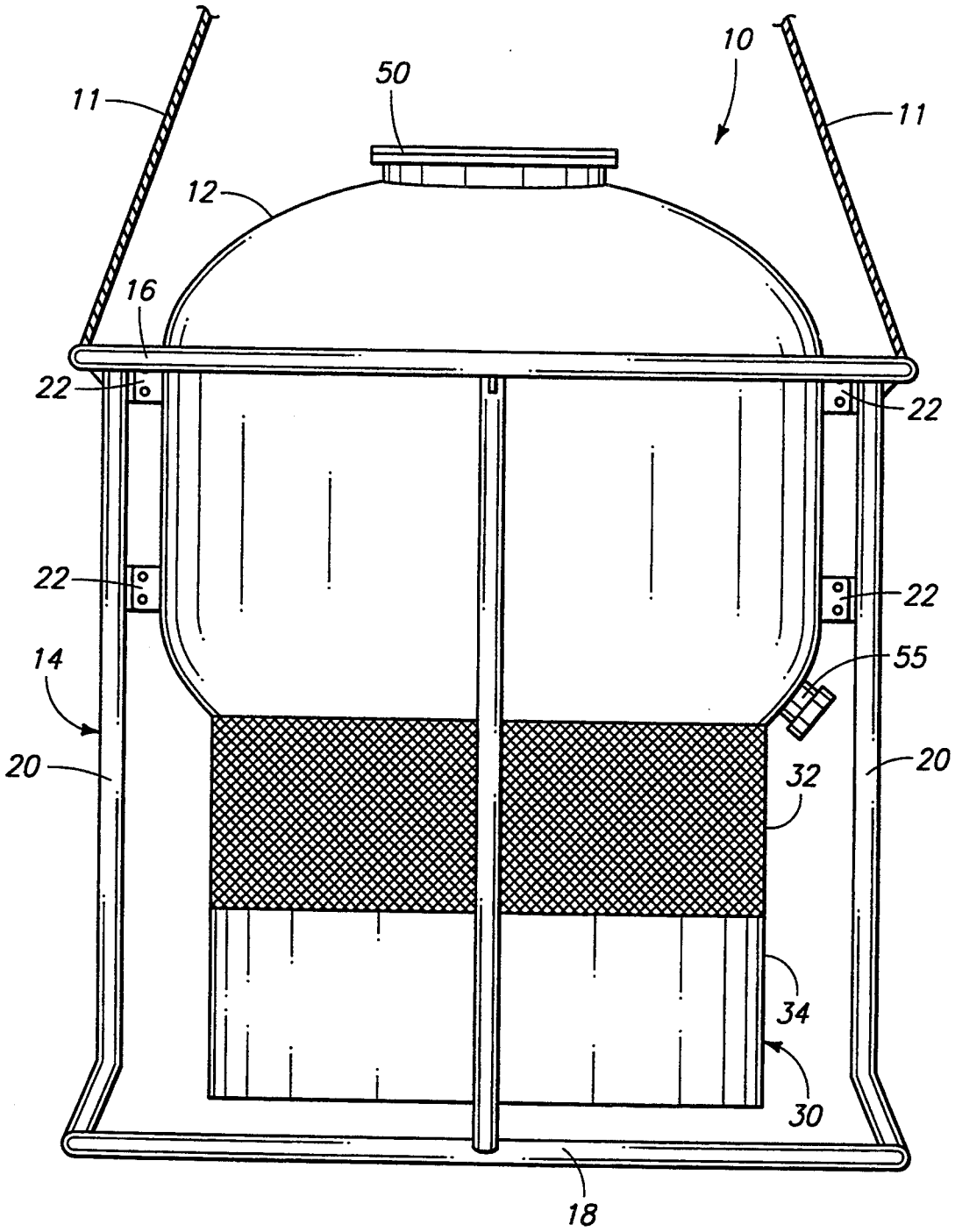
FIG. 1 is a side view of an aerial foam delivery apparatus in accordance with a preferred embodiment of the invention.
Figure 2:
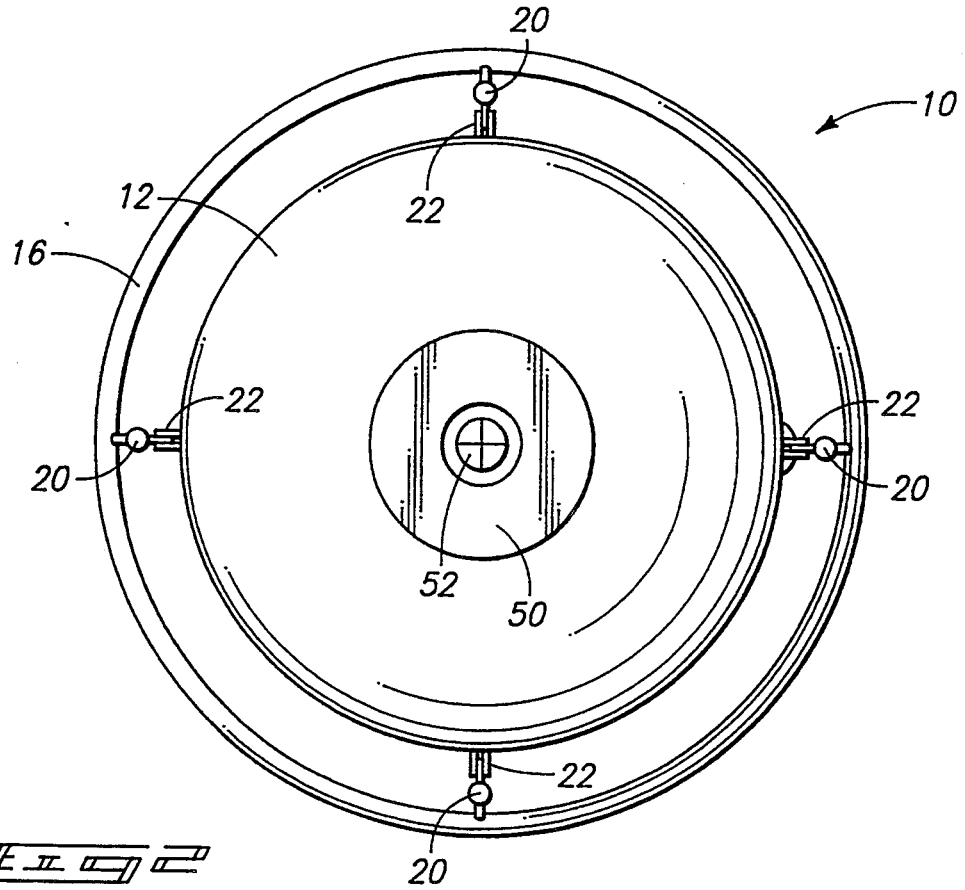
FIG. 2 is a top view of the aerial foam delivery apparatus of FIG. 1.
Figure 3:
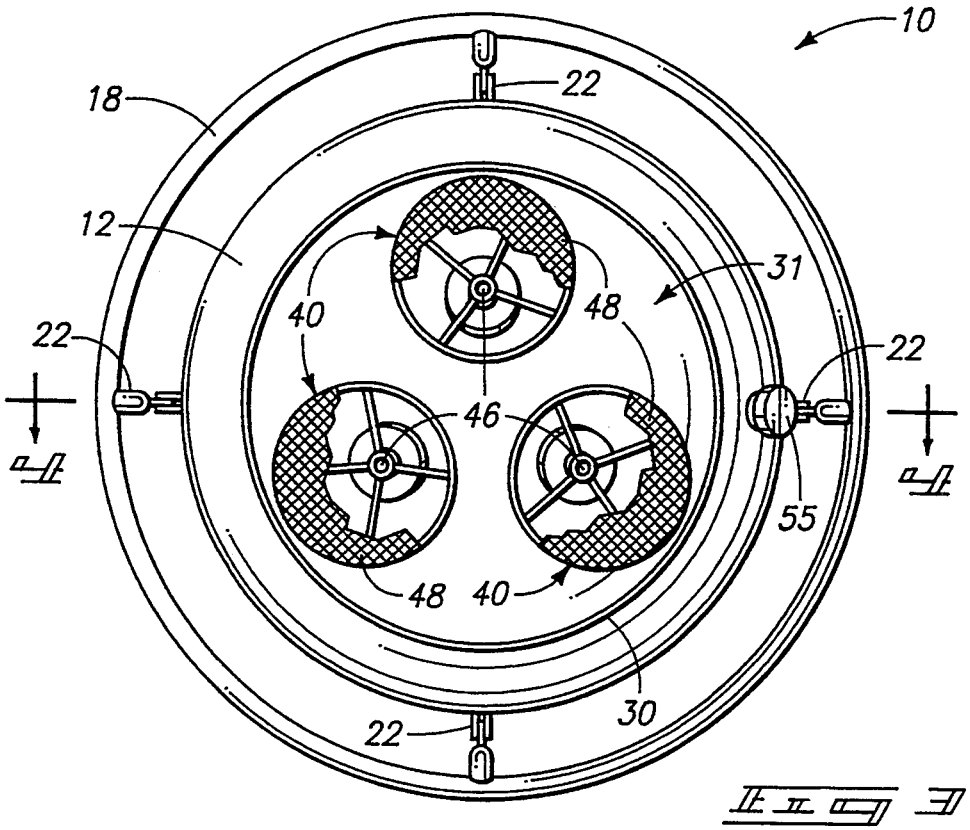
FIG. 3 is a bottom view of the aerial foam delivery apparatus of FIG. 1.
Figure 4:
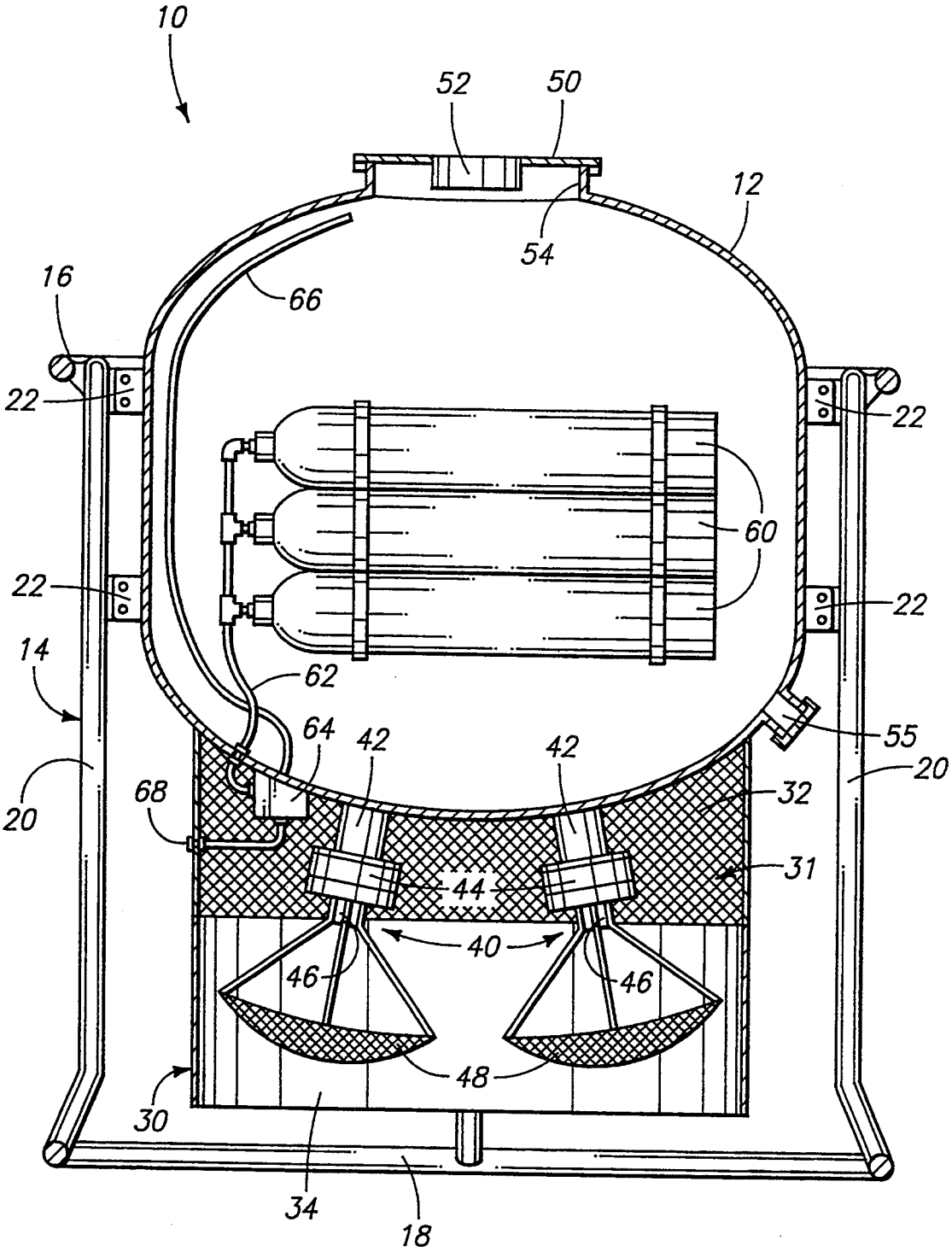
FIG. 4 is a sectional view of the aerial foam delivery apparatus of FIG. 1, taken along the line 4—4 of FIG. 3.

This disclosure of the invention is submitted in furtherance of the constitutional purposes of the U.S. Patent Laws "to promote the progress of science and useful arts." U.S. Constitution, Article 1, Section 8.

FIGS. 1–4 show an airborne foam applicator or foam delivery apparatus in accordance with a preferred embodiment of the invention, generally designated by the reference numeral 10. Foam applicator 10 is designed for operation beneath a helicopter to deliver a high volume of high-expansion fire suppressant foam.

Foam applicator 10 comprises a sealed or sealable liquid tank 12 for holding a foamable liquid such as a water and foam concentrate solution. Liquid tank 12 is generally cylindrical in shape, having a diameter of approximately 6 feet and an interior capacity of approximately 1000 gallons. It is constructed of stainless steel to reduce interaction between internal tank surfaces and contained foamable liquid. Liquid tank 12 is designed to be capable of withstanding positive internal pressures of at least 100 pounds per square inch.

Liquid tank 12 includes mounting features which allow it to be connected to a helicopter sling, in a fashion similar to a helicopter slung bucket, for supporting the liquid tank from beneath the helicopter. Specifically, liquid tank 12 includes a support frame 14 which extends downward from liquid tank 12 to support it above the ground. Support frame 14 includes a circular upper mounting ring 16 which encircles the upper portion of liquid tank 12. Support frame 14 also includes a circular lower support ring 18. Both rings 16 and 18 have a diameter slightly larger than the outer diameter of liquid tank 12. Four support frame legs 20 are spaced about foam applicator 10, and extend vertically between upper ring 16 and lower ring 18.

Support frame 14 serves several functions. For instance, upper ring 16 is connectable to a helicopter sling, allowing foam applicator 10 to be conveniently connected for operation beneath a helicopter. Support frame 14 also serves as a pedestal or stand for supporting liquid tank 12 above the ground when it is not in use or when it is being refilled. In addition, the support frame acts as a bumper or protective guard to reduce damage from collision of foam applicator 10 with other objects. A plurality of mounting brackets 22 extend between legs 20 and liquid tank 12 to position liquid tank 12 within support frame 14.

A protective shroud or apron 30 extends downward from the circular periphery of liquid tank 12 to enclose a central nozzle area 31 directly beneath liquid tank 12. Apron 30 has an upper screened section 32 and a lower solid section 34. Upper screened section 32 is formed of a screen mesh to allow substantial quantities of air to pass through protective apron 30 and into the central nozzle area. Lower solid section 34 is fabricated from a material which blocks air. Protective apron 30 serves both as a physical guard to the enclosed nozzles, and as an air block or wind deflector as will be more fully described below.

Three aerating nozzle assemblies 40 are positioned within central nozzle area 31. Nozzle assemblies 40 are best observed in FIG. 4, being directed generally downwardly from beneath liquid tank 12. The three nozzle assemblies are equally spaced from each other about an imaginary circle beneath liquid tank 12. Each of nozzle assemblies 40 includes a turret pipe 42 which is in fluid communication with the interior of liquid tank 12 and which is directed generally downwardly from the bottom of liquid tank 12. The turret pipes are also directed slightly outward and away from each other, an approximately 12 degree angle from vertical. Each turret pipe 42 has an approximately 2½-inch internal diameter.

Each turret pipe 42 extends from liquid tank 12 to a liquid valve 44, specifically an air-actuated butterfly valve. In the preferred embodiment, butterfly valve 44 is a 2½-inch "type 75" valve manufactured by Asahi/America of Malden, Mass. It is equipped with a pneumatic actuator and an electric solenoid valve 96 for remote actuation. This valve is capable of being fully opened in half a second. While other types of valves could be used, such as diaphragm and gate valves, they would not provide the quick response of the butterfly valve described above. The solenoid valve 96 accepts a 24-volt electrical signal from a helicopter through a control line 97 to release foamable liquid from liquid tank 12.

A nozzle 46 extends beyond each valve 44. Each nozzle 46 has a two inch orifice with a 90-degree full cone projection, allowing a flow of about 945 gallons per minute at 100 pounds per square inch water pressure. At this flow rate, water or foamable liquid emerges from nozzles 46 at a velocity of approximately 96.5 feet per second. A liquid velocity of 60 feet per minute is a preferable minimum for obtaining optimum foam expansion ratios. Nozzles such as used in the preferred embodiment are available from Bete Fog Nozzle of Greenfield, Mass.

One liquid valve 44 thus corresponds to each nozzle, with the liquid valve being operably interposed between the liquid tank and the corresponding nozzle. Liquid valve 44 is remotely operable between a closed position and an open position to allow passage of the foamable liquid through the corresponding nozzle.

An aerating screen 48 is positioned beneath each nozzle 46 to aerate and foam the liquid emerging from the nozzle. The distance from screen 48 to nozzle 46 is important in achieving high foam expansion, and must be determined experimentally for different nozzle types and sizes. In the preferred embodiment, maximum expansion is obtained at a screen-to-nozzle spacing of about 14 inches. Each aerating screen 48 is concave or spherically shaped, having a radius of curvature approximately equal to the distance from the nozzle to the aerating screen. Individual aerating screens are formed in quadrants of stainless steel mesh having a wire spacing of from thirty to sixty wires per inch. The wire spacing in the preferred embodiment is forty wires per inch. Each screen extends over an arc of at least ninety degrees to fully encompass the cone projection of the corresponding nozzle. The screens are mounted to the nozzle assembly by sets of mounting struts.

Liquid tank 12 has a top access hatch 50 which is about 18 inches in width to allow entry of a person into the tank for inspection. Access hatch 50 incorporates a pressure safety head 52 with a rupturable disk to provide secondary protection against excessive internal pressures within tank 12. Access hatch 50 is sealable against a rim 54 with appropriate fastening mechanisms (not shown).

Liquid tank 12 also has a fill port or tank coupling 55 positioned near the bottom of tank 12 to allow filling or refilling the tank with foamable liquid. Locating the fill port on or near the bottom of the liquid tank reduces agitation and aeration within the tank during filling.

Three high-pressure gas containers or canisters 60 are securely mounted within liquid tank 12 for containing compressed gas, and preferably for containing compressed air. Gas canisters 60 have high pressure outputs which are manifolded together through a high-pressure supply line 62. High-pressure supply line 62 extends through the wall of liquid tank 12 to a pneumatic control system 64. A low-pressure supply line 66 extends back into liquid tank 12 from pneumatic control system 64 and upward to the top of liquid tank 12. A high-pressure gas coupling 68 is in fluid communication with pneumatic control system 64 to allow refilling or recharging gas canisters 60 with compressed air from an external source or compressor.

Figure 5:
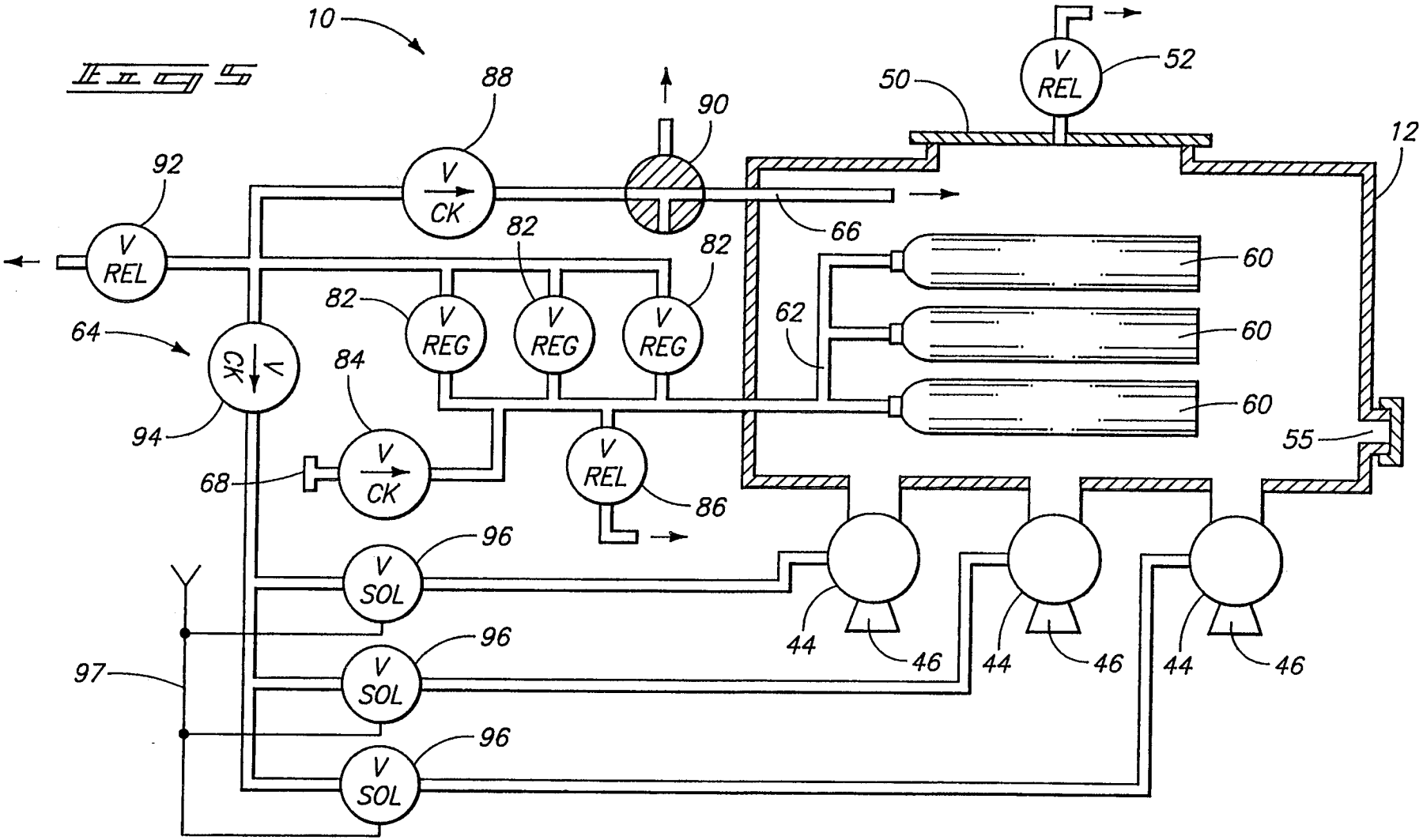
FIG. 5 is a schematic diagram of pneumatic components associated with the aerial foam delivery apparatus of FIG. 1.

Pneumatic control system 64 is shown schematically in FIG. 5, along with associated pneumatic and hydraulic components. As mentioned above, gas canisters 60 are manifolded together through high-pressure supply line 62. Supply line 62 is connected to a plurality of parallel pressure regulators 82, so that the pressure regulators receive compressed air from gas canisters 60. Supply line 62 is also connected through a check valve 84 to high-pressure gas coupling 68. A pressure relief valve 86 is connected to supply line 62.

At least three and possibly four pressure regulators are required to meet the high air flow requirements of the system. Pressure regulators 82 have pressure outputs which are manifolded together and connected for fluid communication with the interior of liquid tank 12. Regulators 82 are operable to controllably discharge compressed air from canisters 60 into liquid tank 12 and to maintain a positive regulated pressure within liquid tank 12. The regulators are set to produce a regulated output of about 100 pounds per square inch. In the preferred embodiment, they must be capable, together, of supplying about 3000 cubic feet of air per minute at 100 pounds per square inch.

The pressure-regulated air is connected through a check valve 88 to a two position valve 90. In a first position, valve 90 allows fluid communication between the regulated outputs of regulators 82 and low-pressure supply line 66. In a second position (not shown), valve 90 allows fluid communication between low-pressure supply line 66 and the ambient atmosphere, or between the interior and exterior of tank 12.

A low-pressure relief valve 92 is also connected to the outputs of pressure regulators 82, and the pressure-regulated air is supplied through a check valve 94 to drive butterfly valves 44, which include close-coupled solenoid actuators 96. A 24-volt valve control line 97 is connected to actuate solenoids 96.

The various control components are contained within apron 30 to be protected from collision with external objects. They are accessed by doors (not shown), with appropriate interlocks (not shown) to protect operators. While still providing a protective function, upper screened section 32 allows entry of air into central nozzle area 31 to permit aeration of the foamable liquid. Nozzles 46 are preferably positioned just below upper screened section 32, within lower solid section 34. Lower solid section 34 protects the nozzles from wind to prevent the wind from interfering with the interaction between the nozzles and aerating screens 48 as applicator 10 is carried by a helicopter.

In operation, foam applicator 10 is prepared for operation by filling liquid tank 12 through fill port 55 with foamable liquid, and by charging gas canisters 60 with compressed air. During filling, two-position valve 90 is set in its second position to isolate the pneumatic control system from the liquid tank interior and to allow air to escape from liquid tank 12.

Filling liquid tank 12 with foamable liquid requires connecting a water supply line (not shown) to fill port 55 and pumping water into the tank. Foam concentrate is added to the water either prior to its entry into tank 12 or by dumping it into tank 12 from access hatch 50.

Concurrently with filling tank 12 with foamable water, an external compressor is connected to high-pressure gas coupling 68 to charge canisters 60 with compressed air. Minimum fill times are desired. resulting in a need for one or more high-horsepower compressors.

The embodiment described above is designed for a working liquid capacity of about 900 gallons. The gas canisters are sized to displace all 900 gallons of liquid under a pressure of 100 pounds per square inch. To meet this requirement, each canister has a capacity of 300 cubic feet at 1800 pounds per square inch. A minimum desirable fill time is five minutes. A more preferable fill time is three minutes. Charging each of these cylinders to approximately 1800 pounds per square inch within three minutes requires an approximately 300 standard cubic feet per minute external compressor or several smaller compressors.

Locating high-pressure canisters 60 within liquid tank 12 results in at least two significant advantages. First, the canisters are protected from collisions with external objects. Second, the heat generated within the canisters by rapidly charging them with compressed air is dissipated by the water within liquid tank 12. This warms the water, resulting in more efficient formation and expansion of foam.

Once the applicator has been filled and charged, two-position valve 90 is returned to its first position. With the valve in this position, the pressure regulators are connected to maintain a positive regulated pressure within the liquid tank of approximately 100 pounds per square inch.

Foam applicator 10 is then borne by a helicopter to a target location for application of foamed fire suppressant over a wildland fire. Applicator 10 is preferably suspended by cables, designated in FIG. 1 by the reference numerals 11, at least 50 feet below the helicopter so that the foam applicator can be operated close to the ground while minimizing downdraft from rotor wash. When over the target, a helicopter pilot actuates a remote release actuator which is connected to supply a 24-volt signal through control line 97 to solenoids 96. This opens butterfly valves 44. The positive pressure within the liquid tank, regulated to 100 pounds per square inch, expels the foamable liquid through nozzles 46 when butterfly valves 44 are operated. The pressure regulators maintain the positive regulated pressure within the liquid tank during expulsion of the foamable liquid, to maintain a constant liquid velocity to aerating screens 48. The foamable liquid is expelled under pressure through nozzles 46 and through aerating screens 48.

The desired maximum time for expulsion of all liquid from the tank is about 30 seconds, corresponding to an expulsion rate of about 1800 gallons per minute. In practice, the particular selection and arrangement of components and regulated pressures as described above are responsible for achieving an expulsion time of less than 19 seconds, corresponding to an expulsion rate of greater than 2800 gallons per minute and a velocity of about 96 feet per second through the nozzle. This rate has not previously been achieved in a device which is practical for airborne operation.

The use of plural nozzles is one feature of the invention which allows such a high expulsion rate. While it would be possible to use a single nozzle, with a larger orifice, this would present practical difficulties. For instance, a larger nozzle would be disproportionately heavier than the combination of three smaller nozzles. The corresponding aerating screen would not work as efficiently with a large nozzle to achieve high expansion rates. Air actuated valves would also be a problem--a 5-inch air-actuated butterfly valve requires four seconds to open, rather than the 0.5 seconds of the specified 2½-inch valve.

Avoiding the use of liquid pumps is another feature which makes the invention practical. An approximately 500 horsepower pump would be required to achieve flow rates of 2800 gallons per minute through the specified nozzles. Such a pump would be as heavy as the entire apparatus described above.

The use of regulated air pressure within a pressurized liquid tank is a further feature which contributes to the practicality of the invention. This feature is in contrast to much smaller devices (such as hand-held fire extinguishers) which charge the entire internal volume of a liquid vessel to a pressure which is high enough to expel all liquid from the vessel. This type of charging would require that liquid tank 12 be capable of withstanding extremely high internal pressures--an impractical requirement in a 1000-gallon tank. Furthermore, it would result in very high initial discharge rates, tapering off to very low discharge rates as the tank was emptied. In contrast, the embodiment of the invention described above achieves a constant discharge rate as the tank is emptied, and requires that the tank be designed for maximum internal pressures of only about 100 pounds per square inch.

The particular nozzle and aerating screen arrangement described above results in very high expansion of foam-much better than is achieved by simply opening dump gates and relying on turbulence generated by the free fall of water through tile atmosphere. The degree of foam expansion is also much higher than would be achieved by use of nozzles alone. Using foam concentrate in conventional slung buckets results in expansion ratios of 12:1. In contrast, tests have indicated that the nozzle and aerating screen described above, when operating at a water pressure of about 100 pounds per square inch, are capable of producing foam expansion ratios of 40:1. These results are achieved when using PHOSCHEK TM WD 881 foam concentrate in a 1% solution.

In compliance with the statute, tile invention has been described in language more or less specific as to structural features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An airborne foam delivery apparatus for operation beneath an aircraft to deliver a high volume of fire suppressant foam, the foam delivery apparatus comprising:

a liquid tank having an interior for holding a foamable liquid, the liquid tank being capable of withstanding a positive internal pressure, the liquid tank being adapted to be carried by the aircraft;

a nozzle which is directed downwardly from the liquid tank;

a liquid valve operably interposed between the liquid tank and the nozzle, the liquid valve being operable between open and closed positions to allow passage of the foamable liquid through the nozzle;

a gas container which is chargeable with compressed gas;

a pressure regulator connected to receive the compressed gas from the gas container, the pressure regulator having an output which is in fluid communication with the liquid tank interior to controllably discharge the compressed gas from the gas container into the liquid tank, the pressure regulator maintaining a positive regulated pressure within the liquid tank to expel the foamable liquid through the nozzle when the liquid valve is in its open position; and protective apron extending downwardly from the liquid tank and encircling the nozzle, the protective apron having an upper portion which is formed by a screen to allow air to pass therethrough.

2. An airborne foam delivery apparatus for operation beneath an aircraft to deliver a high volume of fire suppressant foam, the foam delivery apparatus comprising:

at least one liquid tank having an interior for holding a foamable liquid, the liquid tank being capable of withstanding a positive internal pressure, the liquid tank being adapted to be carried by the aircraft;

a nozzle which is directed downwardly from the liquid tank;

a liquid valve operably interposed between the liquid tank and the nozzle, the liquid valve being operable between open and closed positions to allow passage of the foamable liquid through the nozzle;

a gas container which is chargeable with compressed gas;

a pressure regulator connected to receive the compressed gas from the gas container, the pressure regulator having an output which is in fluid communication with the liquid tank interior to controllably discharge the compressed gas from the gas container into the liquid tank, the pressure regulator maintaining a positive regulated pressure within the liquid tank to expel the foamable liquid through the nozzle when the liquid valve is in its open position; and a protective apron fixed to and extending downwardly from the liquid tank and surrounding the nozzle, the protective apron having an upper portion and a lower portion, the lower portion being solid to deflect wind from the nozzle, the upper portion being open to allow air to pass therethrough.

3. An airborne foam delivery apparatus as recited in claim 2 and further comprising a ground-engaging support frame which extends downwardly from the liquid tank to support the foam delivery, apparatus in an upright position on the ground during refilling.

4. An airborne foam delivery apparatus for suspended operation beneath a helicopter to deliver a high volume of fire suppressant foam, the foam delivery apparatus comprising:

at least one liquid tank having an interior for holding a foamable liquid, the liquid tank being capable of withstanding a positive internal pressure;

means for suspending the liquid tank by one or more lengths of flexible cable from beneath the helicopter;

a nozzle positioned within a central nozzle area and directed downwardly from the liquid tank;

a liquid valve operably interposed between the liquid tank and the nozzle, the liquid valve being operable between open and closed positions to allow passage of the foamable liquid through the nozzle;

a gas container which is chargeable with compressed gas;

a pressure regulator connected to receive the compressed gas from the gas container, the pressure regulator having an output which is in fluid communication with the liquid tank interior to controllably discharge the compressed gas from the gas container into the liquid tank, the pressure regulator maintaining a positive regulated pressure within the liquid tank to expel the foamable liquid through the nozzle when the liquid valve is in its open position; and a ground-engaging pedestal which extends downwardly from the liquid tank to support the foam delivery apparatus in an upright position on the ground during refilling.

5. An airborne foam delivery apparatus as recited in claim 4 and further comprising a protective apron extending downwardly from the liquid tank around the central nozzle area, the protective apron having an upper portion and a lower portion, the lower portion being solid to deflect wind from the central nozzle area, the upper portion being open to allow air to pass therethrough and into the central nozzle area.

6. An airborne foam delivery apparatus as recited in claim 4, the pedestal being formed by a circular support ring surrounding the central nozzle area.

7. An airborne foam delivery apparatus as recited in claim 4 and further comprising a plurality of nozzles.

8. An airborne foam delivery apparatus as recited in claim 4, further comprising an electric solenoid which operates the liquid valve, the electric solenoid accepting an electrical signal from the helicopter to expel the foamable liquid from the liquid tank.

9. An airborne foam delivery apparatus as recited in claim 4, further comprising a high-pressure gas coupling connected to allow recharging the gas container with compressed gas from an external source when the foam delivery apparatus is supported on the ground.

10. An airborne foam delivery apparatus as recited in claim 4, wherein the liquid valve comprises a butterfly valve.

11. An airborne foam delivery apparatus as recited in claim 4, further comprising an aerating screen positioned beneath the nozzle to foam the foamable liquid.

12. An airborne foam delivery apparatus as recited in claim 4, further comprising an aerating screen positioned beneath the nozzle to foam the foamable liquid, the aerating screen being spherically shaped and having a radius approximately equal to the distance from the nozzle to the aerating screen.

13. An airborne foam delivery apparatus as recited in claim 4, wherein the positive pressure within the liquid tank is equal to approximately 100 pounds per square inch.

14. An airborne foam delivery apparatus as recited in claim 4, wherein the positive regulated pressure is sufficient to expel the foamable liquid from the liquid tank at an expulsion rate of at least 1800 gallons per minute.

15. An airborne foam delivery apparatus as recited in claim 4, wherein the positive regulated pressure is sufficient to expel the foamable liquid through the nozzle at a velocity of at least 60 feet per second.

16. An airborne foam delivery apparatus for suspended operation beneath a helicopter to deliver a high volume of fire suppressant foam, the foam delivery apparatus comprising:

a support frame;

at least one liquid tank mounted to the support frame, the liquid tank having an interior for holding a foamable liquid, the liquid tank being capable of withstanding a positive internal pressure;

the support frame including means for suspending the foam delivery apparatus by one or more cables from beneath the helicopter;

the support frame forming a ground-engaging pedestal extending downwardly to support the foam delivery apparatus in an upright position on the ground;

a nozzle positioned within a central nozzle area and directed generally downwardly from beneath the liquid tank;

a liquid valve which is remotely operable between a closed position and an open position to selectively allow passage of the foamable liquid through the nozzle;

a gas container which is chargeable with compressed gas;

a pressure regulator connected to receive the compressed gas from the gas container, the pressure regulator having an output which is in fluid communication with the liquid tank interior to controllably discharge the compressed gas from the gas container into the liquid tank, the pressure regulator maintaining a positive regulated pressure within the liquid tank to expel the foamable liquid through the nozzle when the liquid valve is in its open position; and a protective apron extending downwardly from the liquid tank around the central nozzle area, the protective apron having an upper portion and a lower portion, the lower portion being solid to deflect wind from the central nozzle area, the upper portion being open to allow air to pass therethrough and into the central nozzle area.

17. An airborne foam delivery apparatus as recited in claim 16 and further comprising a plurality of nozzles and a corresponding plurality of liquid valves.

18. An airborne foam delivery apparatus for suspended operation beneath a helicopter to deliver a high volume of fire suppressant foam, the foam delivery apparatus comprising:

at least one liquid tank having an interior for holding a foamable liquid, the liquid tank being capable of withstanding a positive internal pressure;

means for suspending the liquid tank by one or more cables from beneath the helicopter;

a nozzle located within a central nozzle area and directed generally downwardly from beneath the liquid tank;

a ground-engaging support frame extending downwardly beneath the nozzle to support the liquid tank on the ground during refilling;

a liquid valve which is remotely operable between a closed position and an open position to selectively allow passage of the foamable liquid through the nozzle;

a gas container which is chargeable with compressed gas; and a pressure regulator connected to receive the compressed gas from the gas container, the pressure regulator having an output which is in fluid communication with the liquid tank interior to controllably discharge the compressed gas from the gas container into the liquid tank, the pressure regulator maintaining a positive regulated pressure within the liquid tank to expel the foamable liquid from the liquid tank at a rate of at least 1800 gallons per minute.

19. An airborne foam delivery apparatus as recited in claim 18 and further comprising a protective apron extending downwardly from the liquid tank around the central nozzle area, the protective apron having an upper portion and a lower portion, the lower portion being solid to deflect wind from the central nozzle area, the upper portion being open to allow air to pass therethrough and into the central nozzle area.

20. An airborne foam delivery apparatus as recited in claim 18 and further comprising a plurality of nozzles.

21. An airborne foam delivery apparatus as recited in claim 18, further comprising an electric solenoid which operates the liquid valve, the electric solenoid accepting an electrical signal from the helicopter to expel the foamable liquid from the liquid tank.

22. An airborne foam delivery apparatus as recited in claim 18, further comprising a high-pressure gas coupling connected to allow recharging the gas container with compressed gas from an external source when the foam delivery apparatus is supported on the ground.

23. An airborne foam delivery apparatus as recited in claim 18, further comprising an aerating screen positioned beneath the nozzle to foam the foamable liquid.

24. A method of delivering a high volume of fire suppressant foam to a wildland fire, the method comprising the following steps:

filling a liquid tank with a foamable liquid;

charging a gas container mounted to the liquid tank with compressed gas from an external source;

controllably discharging the compressed gas from the gas container into the liquid tank to maintain a positive pressure within the liquid tank;

suspending the liquid tank by means of a length of flexible cable from a helicopter;

carrying the suspended liquid tank beneath the helicopter to a target location over the fire;

remotely actuating a liquid valve to expel the foamable liquid over the fire through an aerating nozzle assembly directed downwardly beneath the liquid tank; and regulating the positive pressure within the liquid tank to provide a constant pressure within the liquid tank during expulsion of the foamable liquid from the liquid tank.

25. A method as recited in claim 24, and further comprising physically shrouding the nozzle assembly during expulsion of the foamable liquid to deflect wind from the nozzle assembly.

26. A method as recited in claim 24, wherein the step of regulating the positive pressure includes a step of regulating the positive pressure to about 100 pounds per square inch within the liquid tank during expulsion of the foamable liquid.

27. A method as recited in claim 24, comprising the following additional steps:

supporting the tank and the nozzle in a fixed upright position on the ground after expulsion of the foamable liquid;

refilling the liquid tank; and recharging the gas container after expulsion of the foamable liquid.

28. A method of delivering a high volume of fire suppressant foam to a wildland fire, the method comprising the following steps:

filling a liquid tank with a foamable liquid;

charging a gas container mounted to the liquid tank with compressed gas from an external source;

controllably discharging the compressed gas from the gas container into the liquid tank to maintain a positive pressure within the liquid tank;

suspending the liquid tank by means of a length of flexible cable from a helicopter;

carrying the suspended liquid tank beneath the helicopter to a target location over the fire;

remotely actuating a liquid valve to expel the foamable liquid over the fire at a rate of at least 1800 gallons per minute through an aerating nozzle assembly directed downwardly beneath the liquid tank;

regulating the positive pressure within the liquid tank to provide a constant pressure within the liquid tank during discharge of the foamable liquid from the liquid tank; and physically shrouding the nozzle assembly during expulsion of the foamable liquid to deflect wind from the nozzle assembly.

* * * * *